US006965309B1

(12) United States Patent
Bleznyk et al.

(10) Patent No.: US 6,965,309 B1
(45) Date of Patent: Nov. 15, 2005

(54) ALARM DATA DELIVERY METHOD

(75) Inventors: Peter P. Bleznyk, Roswell, GA (US); John Steven Engelmann, Roswell, GA (US); Hossein Eslambolchi, Los Altos Hills, CA (US); Charles C. Giddens, Conyers, GA (US); David H. Lu, Morganville, NJ (US); Kenneth James Smith, Dacula, GA (US); Anthony M. Srdar, Alpharetta, GA (US); Harold Jeffrey Stewart, Alpharetta, GA (US); John Vincent Wilson, Conyers, GA (US)

(73) Assignee: AT&T Corp., New York, NY (US)

( * ) Notice: Subject to any disclaimer, the term of this patent is extended or adjusted under 35 U.S.C. 154(b) by 151 days.

(21) Appl. No.: 10/409,229

(22) Filed: Apr. 8, 2003

(51) Int. Cl.[7] ..... G08B 19/00

(52) U.S. Cl. ..... 340/521; 340/506; 340/524; 370/216

(58) Field of Search ..... 340/521, 506, 340/524, 525; 370/216–221, 392, 389; 709/223, 709/224

(56) References Cited

U.S. PATENT DOCUMENTS

| | | | | |
|---|---|---|---|---|
| 6,199,180 | B1 * | 3/2001 | Ote et al. | 714/31 |
| 6,321,081 | B1 * | 11/2001 | Lee | 455/423 |
| 6,414,595 | B1 * | 7/2002 | Scrandis et al. | 340/506 |
| 6,512,740 | B1 * | 1/2003 | Baniewicz et al. | 370/216 |
| 6,577,594 | B1 * | 6/2003 | Abbas et al. | 370/222 |
| 6,646,981 | B1 * | 11/2003 | Kinouchi et al. | 370/216 |
| 6,680,903 | B1 * | 1/2004 | Moriguchi et al. | 370/216 |

* cited by examiner

*Primary Examiner*—Phung T. Nguyen

(57) ABSTRACT

In accordance with the teachings of the present invention, a method is presented for displaying power and heat faults that occur in a network. A server initiates a variety of power alarm display methods. Each method is directed at receiving specific types of power alarm information and displaying or inhibiting the display of this information on a wallboard. The methods operate simultaneously and update the wallboard with power alarm information in near real time. Further, the methods continue to operate and update the display of the power alarm information when tickets associated with the alarms are received or when an operator acknowledges the alarm.

5 Claims, 4 Drawing Sheets

ALARM DATA DELIVERY METHOD

BACKGROUND OF THE INVENTION

1. Field of the Invention

This invention relates to data processing. Specifically, the present invention relates to the data processing of alarm information.

2. Description of the Prior Art

With the incredible emphasis and priority placed on communication networks, there is additional pressure placed on organizations that deploy and maintain communication systems for customers. As a result, service providers are interested in improved methods of operating communication networks.

While each service provider strives for uninterrupted operation of their network, there is no network that can maintain continual operations without failure. Every communication network will have operating failures. As a result, the ability to troubleshoot and correct problems in a communication network is of particular importance to service providers. Therefore, tremendous effort is expended on monitoring, troubleshooting, and correcting network failures.

One particular type of network failure is equipment failure. There is a class of methodologies that are directed at troubleshooting and correcting equipment failure before, during, and after the failure. Further, as a result of experience with troubleshooting equipment failures, service providers have identified a class of equipment failures that they can expect to occur (i.e., deterministic failures).

One type of deterministic failure is power/heat failure. Communications equipment, such as switching equipment, requires power to operate. However, commercial power occasionally fails. Most service providers have deployed battery backups to support communication equipment when power failure occurs. The battery backup will typically operate when the commercial power fails. However, batteries have a limited lifetime. Therefore, many service providers have also deployed gasoline-powered generators to keep the office powered. For some offices, the batteries are there to provide power to the office until a portable generator can be connected. For offices that have a generator already in the building, the batteries keep the equipment powered until the generators are started.

In addition to power failures, equipment also fails as a result of overheating. Therefore, in addition to monitoring equipment for power failure, the temperature of the equipment is also monitored to determine when the equipment is reaching a critical heat limit. Prior to reaching the critical limit, operators are dispatched to address the problem.

A variety of different systems are deployed to alert network operators of power failure and heat failure. However, these systems are rarely consolidated. In addition, many of these systems were phased into the network at different times. As a result, there may be a mixture of disparate systems within the network. For example, each system may monitor one type of problem, one region of the country, one customer, etc.

Many of these systems log network problems, but do not alert the operator. Therefore, a network problem may go unnoticed for a period of time (i.e., several minutes to hours). In cases where a generator is running out of gasoline or the heat in a communication component is rising toward a heat limit, time is critical. As a result, a network operator has to continually access and monitor a variety of systems (i.e., log files) to look for network problems.

In addition, each failure often generates a trouble ticket. Given the size of modern networks, the amount of trouble tickets may be voluminous. Analyzing a large amount of trouble tickets for the most critical failures may cause the network operator to lose critical time, if they are able to identify and isolate the trouble ticket at all.

Thus, there is a need for a method that consolidates information on power/heat failures. There is a need for a method of consolidating power/heat failure information in disparate networks. Lastly, there is a need for a method of consolidating information on network failures and presenting the information to a network operator in a quick and efficient manner.

SUMMARY OF THE INVENTION

A method of providing user-friendly access to real-time failure information is presented. In one embodiment of the present invention, a method of providing end users with real-time power/heat failure information is presented. Power/heat failure information is acquired, processed in real time, and presented to network operators on a large display (i.e., wallboard), so that the network operator can analyze and coordinate a response (i.e., deployment, further testing, etc.) in near real time.

An integrated system is presented in which rules are applied to alarms (i.e., power/heat alarm information). Tickets are then generated based on the outcome of the rules and forwarded to a network portal. In addition, high priority power/heat alarms are identified and directed to the network portal. Additional information is also transmitted to the network portal, such as network event information, battery information, map information, etc. The network portal consolidates the different types of information and forwards the information to a display server (i.e., wallboard server). The wallboard server performs a variety of alarm display methods and then generates information that displays the power/heat alarms on a wallboard.

As such, a network operations center can proactively analyze the alarm. The criticality of the alarm can quickly be ascertained to determine whether a network operator should be dispatched or whether ample resources (power, battery, etc.) exist to delay the dispatch. In addition, quick identification of the alarm may afford a network operator sufficient time to provide notification to external organizations/vendors, power engineers, and upper management as necessary so that they can determine alternate plans if required. If the alarm automatically clears prior to ticket creation, it is automatically deleted from the wallboard.

In the case where an external/internal vendor calls in a real-time network event (i.e., network failure) pertaining to a power/heat alarm, the network operator can quickly query a ticket system based on the network event to determine the associated ticket. Once the ticket is retrieved, the network operator can input or change the completion time of the network event based on information supplied by the vendor and save it to a power/heat work list (i.e., list of power/heat alarms). This will trigger the network event to be displayed on the wallboard. If the network event is not completed by the completion time, then the wallboard will reflect an increase in severity (i.e., change color of the text, etc.).

A method of displaying information comprises the steps of receiving map information transmitted across a network; generating map display information in response to receiving the map information, the map display information causing a map to be displayed on a screen; receiving power alarm information transmitted across the network, the power alarm information representing a power fault in the network; and generating alarm display information in response to the power alarm information, the alarm display information causing power alarms to be displayed on the screen.

A method of displaying alarms comprises the steps of receiving alarm information, the alarm information comprising technology number information, alarm number information, location information, and inhibit code information; generating alarm type information in response to the technology number information and in response to the alarm number information; and initiating an alarm display method in response to the inhibit code information, in response to the alarm type information and in response to the location information, the alarm display method causing power alarm information to be displayed.

A method of processing alarm tickets comprises the steps of receiving alarm information, the alarm information representing a power fault in the network; generating first display information, the first display information causing display of first alarm information; receiving ticket information, the ticket information representing the power fault in the network; correlating the alarm information with the ticket information; and generating second display information in response to correlating the alarm information with the ticket information, the second display information causing display of second alarm information.

A method of processing power alarms comprises the steps of receiving first power alarm information representing an alarm; determining if an inhibit method is operating in response to the first power alarm information; displaying second power alarm information in response to determining if the inhibit method is operating; determining if a ticket has been generated; receiving ticket information in response to determining if the ticket has been generated; correlating the first power alarm information and the ticket information in response to receiving the ticket information; and generating third power alarm information by updating the second power alarm information in response to correlating the first power alarm information and the ticket information.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
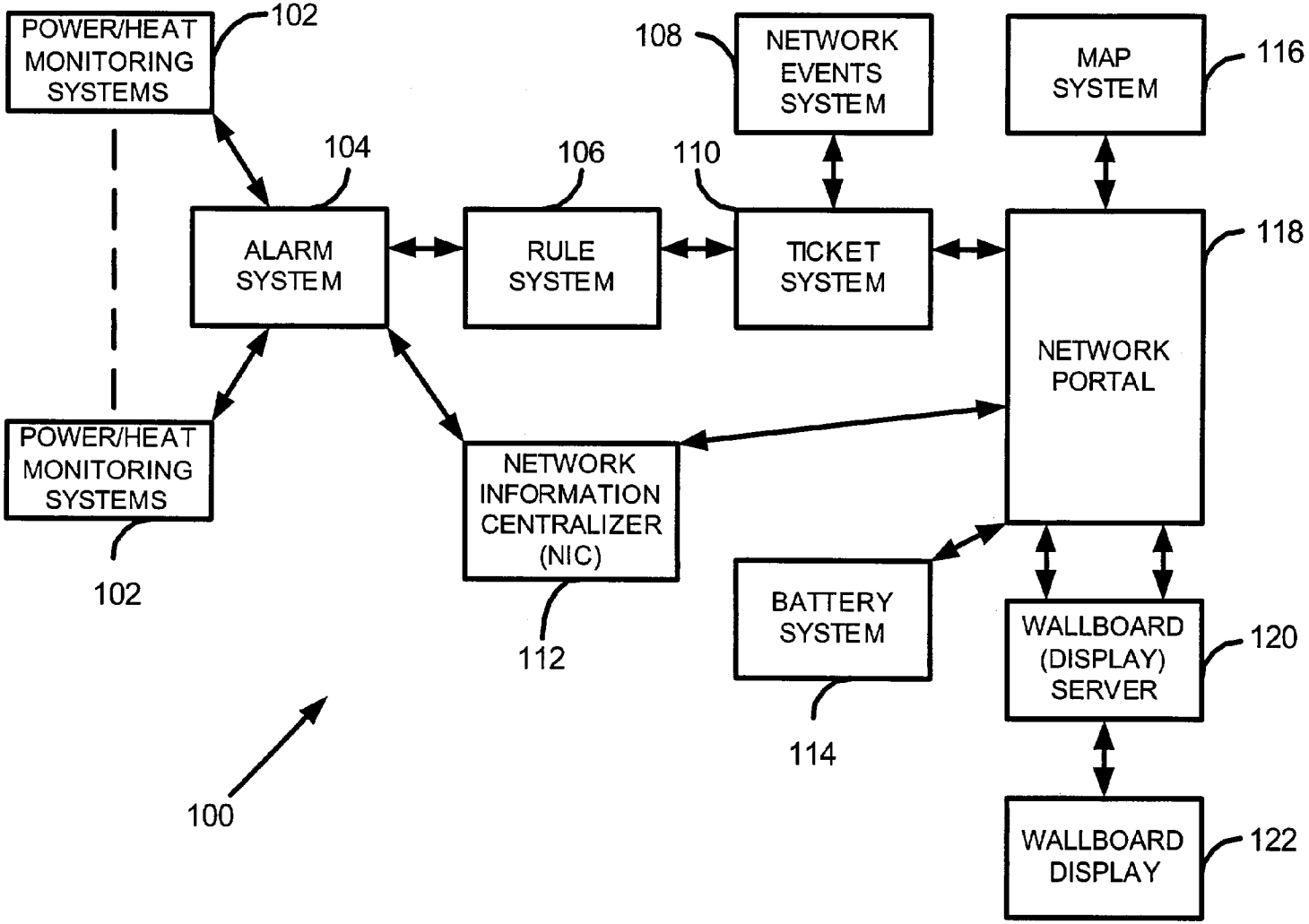
FIG. 1 displays a block diagram of an architecture implemented in accordance with the teachings of the present invention.

FIG. 1 displays a block diagram of network architecture 100 implemented in accordance with the teachings of the present invention. The components of the network architecture 100 may communicate across a single network. For example, the components of the network architecture 100 may communicate across packet-switched networks, circuit-switched networks, wireless networks, etc. In an alternate embodiment of the present invention, each component of the network architecture 100 may communicate through a separate network. Further, each component of the network architecture 100 may be implemented in a separate computer as a distributed architecture or components may be combined into one computer architecture.

In FIG. 1, power/heat monitoring systems 102 are shown. The power/heat monitoring systems 102 may perform power monitoring or heat monitoring of equipment in a communication network. Alarm system 104 acquires power/heat alarm information from the power/heat monitoring systems 102. The power/heat alarm information is information that is generated by the power/heat monitoring systems 102 when a power fault (i.e., power failure or heat condition) occurs in the network. As a result of this failure or fault in the network, ancillary equipment, such as generators, temperature sensors, etc., generate alarms. These alarms include battery on discharge alarms, high room temperature alarms, a stationary generator/low fuel alarm, a portable generator/low fuel alarm, a fault reported by a network operator (i.e., network faults), etc. As a result of the foregoing, the monitoring system acquires and generates power alarm information which is information associated with a power fault, such as a battery on discharge alarm, a high room temperature alarm, a stationary generator/low fuel alarm, a portable generator/low fuel alarm, a fault reported by a network operator (i.e., network faults), etc. The alarm system 104 generates additional alarm information that is used later in the network architecture 100 to generate visual alerts, such as the variables defined in Table 1 given below.

TABLE 1

| VARIABLE | DEFINITION |
|---|---|
| set_clear_var | This variable is set to either "set" or "clear" (i.e., set the new alarm or clear an existing alarm). |
| alarm_inhibit_var | This variable is set to "ALARM" if the alarm information defines an alarm or "INHIBIT" to inhibit alarms for that location. |
| location_var | This variable identifies the location of the alarm on a map. |
| account_var: | This variable contains the inhibit code (what types of alarms are we preventing from appearing on the wallboard). Also, it contains the estimated completion time (ECD). |
| tech_no: | This variable defines the technology category of the alarm. |
| alm_no: | This variable is the alarm number (i.e., identifies the type of alarm). |

The tech_no and the alm_no are used later in the network architecture 100 to determine the alarm name. An example of the correlation between the technology number (tech_no), the alarm number (alm_no), and the alarm name are given below in Table 2 for different types of alarms.

TABLE 2

| tech_no | alm_no | ALARM NAME |
|---|---|---|
| 100 | 52 | Battery on Discharge −24 |
| 103 | 21 | High-Low Volt +130 |
| 403 | 11 | High Room Temperature |
| 120 | 7 | Commercial AC Power Failure |
| 200 | 19 | Low Fuel Main Tank |

The alarm system 104 is in communication with rule system 106. Rule system 106 applies rules to determine if a ticket should be created for an alarm (i.e., alarm information). For example, given the amount of tickets that may be generated, a rule may be put in place to generate tickets on alarms with a priority of x, where x is a high priority.

Rule system 106 then forwards information to the ticket system 110. Ticket system 110 generates tickets and modifies tickets. A ticket includes alarm information on a specific alarm or group of alarms. For example, a ticket may include information such as a ticket ID, notify status field that provides alarm status, an assign ID which identifies who is responsible for the repair, the type of alarm, etc. See Tables 3 and 4 given below for a definition of the variables that may be included in a ticket.

TABLE 3

| VARIABLE | DEFINITION |
|---|---|
| Ticket ID | Used to correlate an alarm to a ticket. |
| Notify status | Provides information on the state of operations. |
| Assign ID | Used to correlate a network operator to the ticket. |

The definitions of the notify status variables are given below in Table 4.

TABLE 4

| NOTIFY STATUS VARIABLES | DESCRIPTION |
|---|---|
| AL | Alarm - Will be created by wallboard (display) server 120 for any alarm where set_clear_var = set and a ticket does not exist |
| SD | Sent by rule system 106 when a high priority ticket (Battery On Discharge, Low Voltage, High Room Temp, Low Fuel) is created or an additional high priority alarm is received on that ticket |
| SA | Changes from SD to SA when a network operator acknowledges the alarm on the ticket |
| WS | Sent by rule system 106 when a ticket is created or an additional alarm is received on that ticket |
| WA | Changes from WS to WA when a network operator acknowledges the alarm on the ticket |

During operation, a collection of tickets is arranged (i.e., ordered) into a work list. As such, a network operator is able to collect a list of relevant tickets and prioritize them. The ticket system 110 includes the capability to automatically refresh the work list (i.e., every five minutes) or refresh the work list on demand based on the priority of an alarm. The ticket system 110 communicates through the network portal 118 to notify a wallboard (display) server 120 of high priority ticket changes and network events. In addition, when the ticket system 110 updates the tickets (i.e., automatically or on demand), the ticket system 110 forwards the updated ticket information to the wallboard (display) server 120 via the network portal 118.

A network events system 108 is in communication with the ticket system 110. The network events system 108 collects a variety of network alarms and communicates network event tickets to the ticket system 110. Therefore, the ticket system 110 receives both power alarm information from the alarm system 104 and network event information from the network events system 108. As a result, in one embodiment of the present invention, the ticket system 110 generates both power/heat related tickets and network event related tickets.

The alarm system 104 is also in communication with a Network Information Centralizer (NIC) 112. The NIC 112 receives the alarm information from the alarm system 104 and performs correlation of high priority alarm information. The alarm information is then communicated to the network portal 118 without being filtered so that the network portal 118 has a full copy of the alarm information.

The ticket system 110 and the NIC 112 are in communication with the network portal 118. The network portal 118 consolidates a variety of functions related to network operations into a cohesive information system. In one embodiment of the present invention, the network portal 118 may include a variety of disparate information systems consolidated into a unified interface through technology, such as web services as defined by the World Wide Web Consortium. In an alternative embodiment, the network portal 118 may include a single distributed system directed at network operations.

The network portal 118 receives three types of records (i.e., set alarm, clear alarm, and inhibit) from the ticket system 110. A set alarm record includes an alarm ID and sets an alarm. The set alarm record is forwarded to the wallboard (display) server 120 and initiates an alarm display method in a wallboard (display) server 120. The alarm display method generates alarm information to be displayed on the wallboard display 122. A clear alarm record indicates that an alarm situation no longer exists. The clear alarm record contains the same alarm ID as the set alarm record. The clear alarm record is forwarded to the wallboard (display) server 120 and initiates an alarm display method in the wallboard (display) server 120, which clears alarms from the wallboard display 122. An inhibit record indicates that planned maintenance is going to take place at an office. All alarms from that office will be ignored. There is a timestamp (i.e., ECD) identifying when work will start and a timestamp identifying when work should be completed. The inhibit record is communicated through the network portal 118 to the wallboard (display) server 120 and causes the wallboard (display) server 120 to initiate an inhibit method. The inhibit method prevents the display of alarms on the wallboard display 122.

The network portal 118 may solicit systems for additional information. For example, a battery system 114 provides the network portal 118 with battery information. Battery information includes information on the batteries deployed in the network, such as battery type, battery capacity, battery location, etc. The battery information is used by the network portal 118 to determine how much battery life remains in a battery deployed in a specific office. If the battery life is low, then the priority of the alarm is increased. The battery system 114 generates the battery variables shown in Table 5.

TABLE 5

| VARIABLE | DEFINITION |
|---|---|
| BHR | Battery Hours in Reserve. This value defines the maximum hours that the office can run on batteries |
| CBHR | Calculated Battery Hours in Reserve. This is calculated from the BHR to determine how many hours of battery life remains. |

The network portal 118 is in communication with a map system 116, which provides detailed geographical information of network locations. The map system 116 may be deployed in a computer with an associated database. Further, the map system 116 may be in communication with a real-time source of geographic information so that the map information is current.

The network portal 118 communicates with a wallboard (display) server 120. The wallboard (display) server 120 processes information received from the network portal 118 and communicates the information to the wallboard display 122. The wallboard (display) server 120 initiates methods (i.e., software), which display battery information, high room temperature information, and generator (stationary, portable) information on the wallboard display 122 in near real time. After the methods are initiated by the wallboard (display) server 120, display information is generated by the wallboard (display) server 120 and communicated to the wallboard display 122.

Alarm information is displayed on a wallboard display 122. In one embodiment of the present invention, the wallboard display 122 is implemented with a large screen, such as a plasma screen in a network operations center. As such, network operators are visually alerted to power alarms in near real time and may take action. The power alarm information may be displayed as an overlay on a map, as text information, etc.

Figure 2:
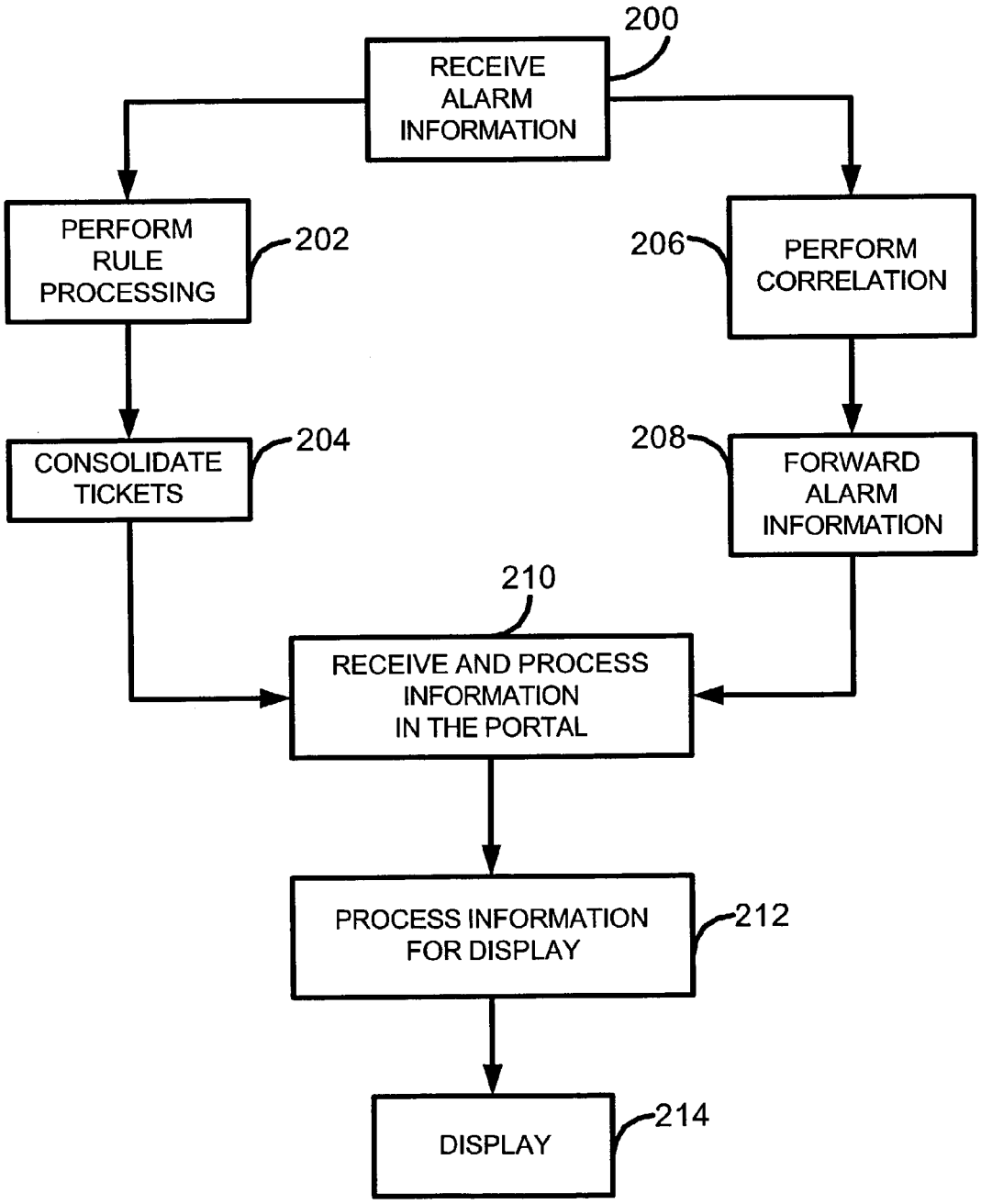
FIG. 2 displays a method of operating the architecture of FIG. 1.

FIG. 2 displays a method of operating the network architecture 100 of FIG. 1. Therefore, FIG. 2 will be described in conjunction with FIG. 1. During operation, the power/heat monitoring systems 102 receive alarm information as stated at 200. The rule system 106 performs rule processing on the alarm information as shown at 202. The network events system 108 produces network ticket information, which is acquired by ticket system 110. The network ticket information is consolidated with power alarm information generated by rule system 106. As a result, the ticket system 110 produces two types of tickets (i.e., network tickets and power/heat tickets) which are consolidated as stated at 204. The NIC 112 correlates alarm information as stated at 206. The NIC 112 then forwards the alarm information to the network portal 118 as stated at 208. At 210, the network portal 118 receives information from the ticket system 110 and from the NIC 112. Further, the network portal 118 retrieves battery information from the battery server 114 and map information from the map system 116. The network portal 118 performs processing on the various types of information as stated at 212. The wallboard (display) server 120 processes information for display by initiating various display methods as stated at 212. Alarm information is then displayed on a wallboard, as stated at 214.

Figure 3:
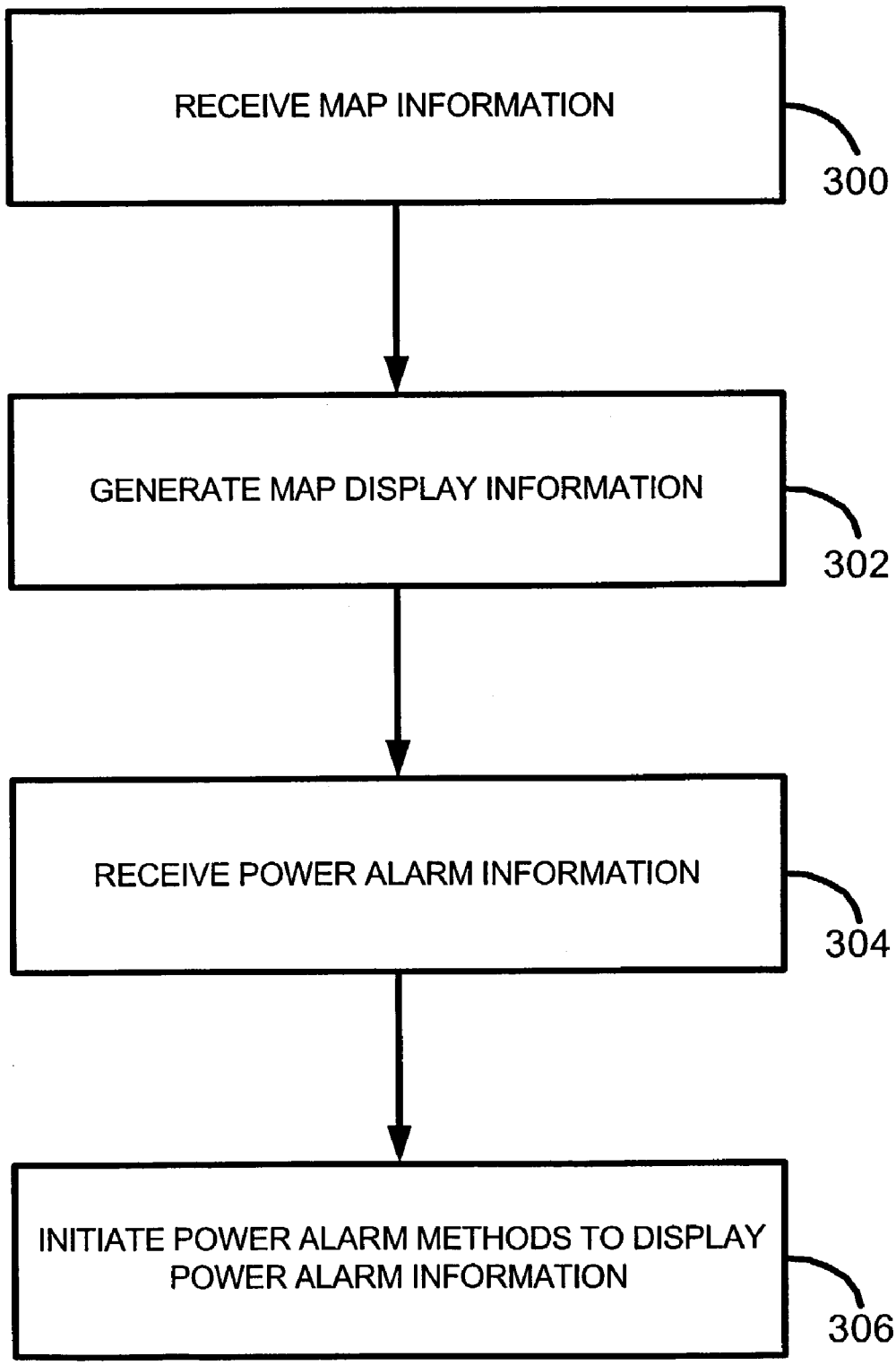
FIG. 3 displays a server method implemented in accordance with the teachings of the present invention.

FIG. 3 displays a method of operating a server, such as wallboard (display) server 120, in accordance with the teachings of the present invention. FIG. 3 will be described in conjunction with FIG. 1. At step 300, the wallboard (display) server 120 receives map information. Map information may be considered any information required to display a map on a display device, such as a wallboard display 122. In one embodiment of the present invention, the wallboard (display) server 120 acquires national weather map(s) from a predefined URL(s). The map information is acquired from a web site that maintains continuous map information, such as a news station web site, weather station web site, etc.

At step 302, the wallboard (display) server 120 generates map display information. The map display information displays a map on the wallboard display 122. During the map display, the wallboard (display) server 120 may automatically change views of the map information based on predefined intervals.

At step 304, the wallboard (display) server 120 receives power alarm information. The power alarm information includes the alarm information forwarded from the NIC 112 as well as the ticket information forwarded from the ticket system 110. The power alarm information includes information, such as the technology number, alarm number, inhibit code, location, etc. At 306, the wallboard (display) server 120 initiates alarm display methods to display power alarm information on the wallboard display 122. The alarm display methods include processes that receive alarm information, ticket information, map information, location information, and battery information and display power alarm information on the wallboard display 122 in response to the information. It should be appreciated that initiating a method includes starting a method that operates on wallboard (display) server 120 or starting a method on wallboard server 120, which initiates a method that operates on another machine.

Several alarm display methods are initiated by the wallboard (display) server 120. In one embodiment of the present invention, an inhibit method is initiated by wallboard (display) server 120, a battery on discharge method is initiated by wallboard (display) server 120, a high room temperature method is initiated by wallboard (display) server 120, a stationary generator method is initiated by wallboard (display) server 120, a portable generator method is initiated by wallboard (display) server 120, and a network events method is initiated by wallboard (display) server 120.

The inhibit method is a method that inhibits alarms, such as power alarms from being displayed on the wallboard display 122. The battery on discharge method is a method that displays information associated with a discharging battery on the wallboard display 122. The high room temperature method is a method that displays information associated with a high equipment room temperature on the wallboard display 122. The stationary generator method is a method that displays information associated with low fuel in a stationary generator on the wallboard display 122. The portable generator method is a method that displays information associated with low fuel in a portable generator on the wallboard display 122. The network events method is a method that displays power alarm information that is introduced by network personnel.

The various display methods receive power alarm information from the NIC 112 and receive ticket information from the ticket system 110. Both the ticket information and the power alarm information may provide information on the same alarms. However, in one embodiment of the present invention, the power alarm information is forwarded immediately and the ticket information is processed through the ticket system 110 before forwarding. The wallboard (display) server 120 initiates the alarm display methods so that alarms can be deployed when they are received from the NIC 112. If the power alarm is resolved before the ticket information arrives at the wallboard (display) server 120, an alarm display method removes the alarm from the wallboard. When the ticket information associated with a power alarm arrives at the wallboard (display) server 120, the wallboard (display) server 120 using the alarm display method performs a correlation between the power alarm information (i.e., generated by NIC) and the ticket information. The wallboard display 122 is then updated based on the correlated information. An update may include changing the information displayed on the wallboard display 122, overlaying additional information on the wallboard display 122, or removing information from the wallboard display 122.

The alarm display methods continue to run and at predefined periods receive updated tickets, which are used to update information on the wallboard display 122. The alarm display methods receive operator input, such as acknowledgements that an operator has been assigned, acknowledgements that the fault has been resolved, etc. The alarm display method then updates the display based on the operator input.

Figure 4:
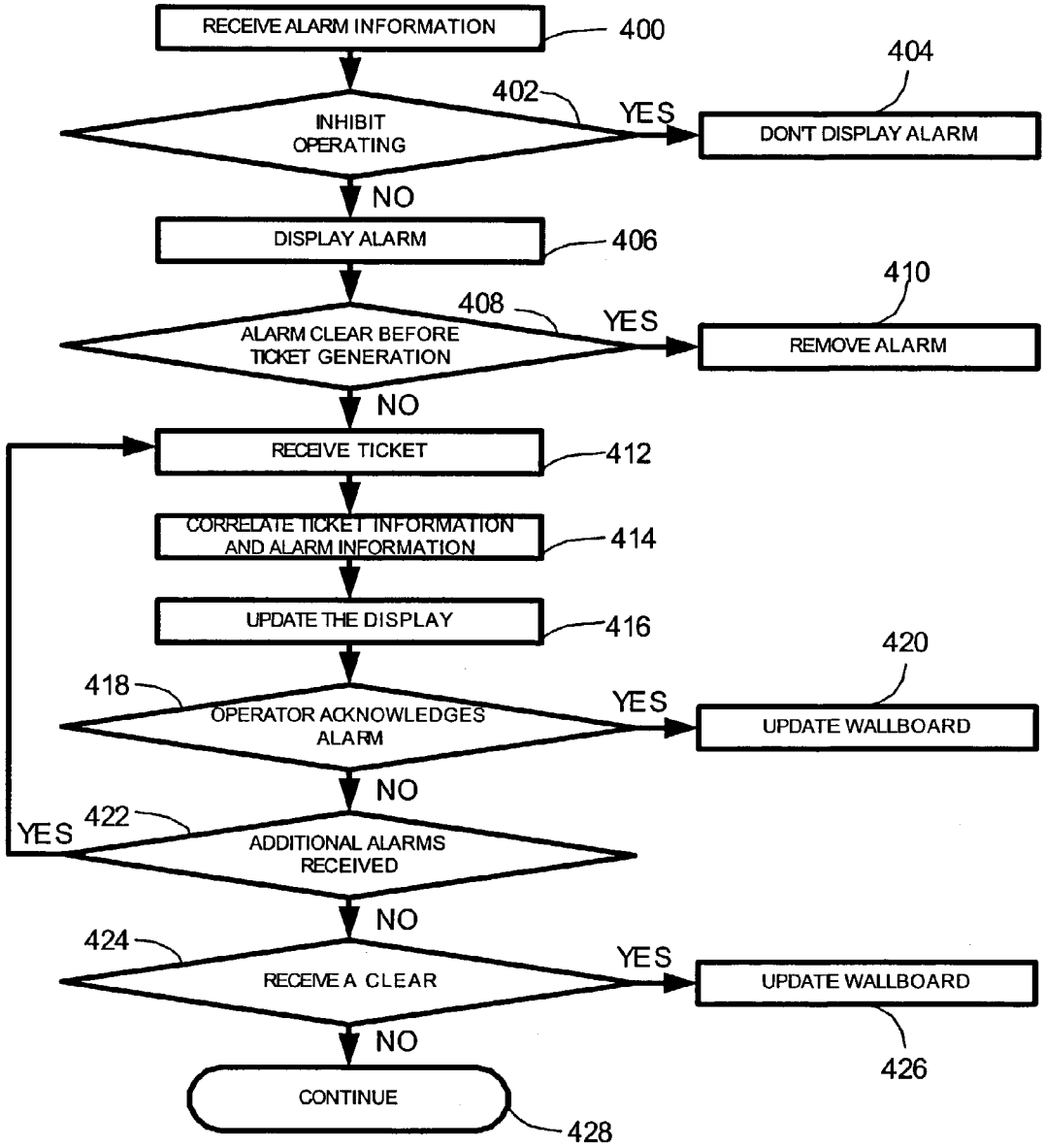
FIG. 4 displays an alarm display method implemented in accordance with the teaching of the present invention.

FIG. 4 displays an alarm display method implemented in accordance with the teaching of the present invention. In FIG. 4, alarm information is received in the wallboard (display) server 120 of FIG. 1 as stated at 400. The alarm information may include location information, technology number information, technology type information, and inhibit code information. A test is made to determine if the wallboard (display) server 120 is running an inhibit method as stated at 402. If the wallboard (display) server 120 is running an inhibit method, the alarm is not displayed as stated at 404. If the wallboard (display) server 120 is not running an inhibit method, the alarm is displayed on a wallboard display 122 of FIG. 1 as shown at 406. If the alarm clears before a ticket is generated as stated at 408, then the alarm is removed from the wallboard display 122 as shown at 410. If the alarm does not clear before a ticket is generated, then a ticket is received in the wallboard (display) server 120 as stated at 412. The ticket information is then correlated with the alarm information as stated at 414. As a result, the wallboard display 122 is updated with most current information or with any additional information as stated at 416. If an operator acknowledges the alarm as stated at 418, the wallboard display 122 is updated to reflect that an operator has acknowledged the alarm. If no operator has acknowledged the alarm, a test is made to determine if additional alarms are received as stated at 422. If additional alarms are received, then the display method loops back to receiving the ticket associated with the alarm as stated at 412. If no additional alarms are received, the wallboard (display) server 120 tests to determine if a clear has been received as stated at 424. If a clear has been received, then the wallboard (display) server 120 updates the wallboard display 122 by removing the alarm information as stated at 426. If no clear has been received, the process continues as stated in 428. Continuing as stated at 428 may include looping back to perform other steps or continuing may include performing specific steps associated with each display method detailed below.

In accordance with one embodiment of the present invention, alarm display methods control the display of the power/heat alarm information on the wallboard display 122. In one embodiment of the present invention, the alarm display methods include: (1) an inhibit method; (2) a battery on discharge/low voltage method; (3) a high room temperature method; (4) a stationary generator low fuel method; (5) a portable generator low fuel method; and (6) a network events method.

An inhibit method is presented. The inhibit method is used to inhibit power alarms to the wallboard (display) server 120. As a result, specific power alarms are ignored when the inhibit method is operational. One embodiment of the inhibit method may be implemented with the following steps:

1. The alarm system 104 forwards alarm information to the NIC 112. In one embodiment of the present invention, the alarm information includes alarm_inhibit_var information, account_var information, location information, and map information.
2. The NIC 112 forwards the alarm information to the network portal 118, which forwards the alarm information to the wallboard (display) server 120.
3. The wallboard (display) server 120 analyzes the alarm information to determine which alarms to inhibit as part of the inhibit method.
4. The wallboard (display) server 120 uses an inhibit code (i.e., 1-5) in the account_var variable and compares this code to a table (i.e., Table 2) which correlates an alarm name with a technology number (i.e., tech_no) and alarm number (i.e., alm_no). The network portal 118 uses the map information (i.e., location_var) to inhibit alarms for the location_var identified location. The inhibit method will remain in place for a specified period of time (i.e., 90 minutes). Any alarm(s) that are sent that match the technology number and alarm number based on the inhibit code (i.e., 1-5) during the inhibit method are reviewed and terminated so that the alarm is not sent to the wallboard display 122.

A Battery On Discharge (BOD) method is presented in the present invention. In one embodiment of the present invention, the Battery On Discharge method includes the following steps:

1. The alarm system 104 forwards "Battery on Discharge" alarm information to the NIC 112 with alarm information, such as the alarm information provided in Table 1 given above.
2. The NIC 112 forwards Battery on Discharge alarm information (i.e., set_clear_var=set, clear; alarm_inhibit_var= ALARM, inhibit, tech_no, alm_no) to the network portal 118, which determines whether the alarm information should be forwarded to the wallboard (display) server 120 based on tech_no and alm_no.
3. The wallboard (display) server 120 determines whether an inhibit method is operating on a location_var location for a specific technology number (i.e., tech_no), alarm number (i.e., alm_no), and inhibit code (1-5):
   If an inhibit method is operating, then the alarm is terminated and will not be displayed on the wallboard display 122.
   If an inhibit method is not operating, the alarm is displayed on the wallboard display 122. It should be appreciated that the battery information may be displayed on the wallboard display 122 in a variety of formats, such as graphic, text, video, and still remain within the scope of the present invention.
4. In one embodiment of the present invention, the wallboard display 122 generates display information to display alarm information on the wallboard display 122 in the following manner:
   Text Color=Red for BOD information, Flashing Red for Low-Voltage information;
   ID field=blank or ticket ID;
   Notify State Field=See Table 2 above;
   location_var—Location where alarm was reported;
   Date/Time=Date and Time when the alarm was reported;
   Assign ID—blank, unless ticket was assigned to a network operator;
   Alarm Type—Battery On Discharge, Low Voltage based on tech_no, alm_no;
   CBHR (calculated battery hours in reserve)—retrieved from battery system 114—every hour this value will be decreased by one unit and redisplayed;
   Floor Number;
   Voltage;
   Additional Data may include—depletion percentage (calculated based on original value, current value, elapsed time), power plant type, normal load, date read, address, and network operator phone number.
5. If Battery on Discharge (BOD) clears (i.e., set_clear_var=clear) before a ticket is created, then:

The NIC 112 sends a clear signal to wallboard (display) server 120 via the network portal 118;

The wallboard (display) server 120 generates updated information that removes the alarm from the wallboard display 122.

6. After a specified elapsed time, if the alarm still exists, the rule system 106 uses rules to create a ticket with Notify=SD and sends alarm information attributes (i.e., see Table 1, such as object, set_clear_var, tech_no, alm_no) to the ticket system 110.
7. As a result, the ticket system 110 automatically refreshes the work list based on the Notify=SD information. In another embodiment of the present invention, the work list may be updated every five minutes or on demand.
8. The ticket system 110 notifies wallboard (display) server 120 that a ticket has been created/changed and forwards ticket information (ticket ID, location_var, Notify State) and alarm information provided by the rule system 106.
9. The wallboard (display) server 120 correlates existing pre-ticket alarm(s) to ticket alarm(s) and populates the wallboard display 122 with alarm information.
10. If a network operator acknowledges the "SD" alarm, the ticket "Notify" field status changes from "SD" to "SA". The ticket system 110 notifies the wallboard (display) server 120 of the change; the wallboard (display) server 120 changes the "Notify" status of the associated alarm to "SA".
11. If any additional "SD" alarms are sent to the network portal 118 from the rule system 106 on the same ticket, then follow steps 6–9 and include new alarm information generated by the alarm system 104.
12. If the alarm system 104/NIC 112 receives a "clear" (set_clear_var=clear) on any of the OPEN alarms, then NIC 112 sends "clear" to wallboard (display) server 120 via the network portal 118.
13. The wallboard (display) server 120 will use the alarm information (i.e., set_clear_var=clear) to delete the alarm from the wallboard display 122.
14. If a Low-Voltage alarm is received by ticket system 110 and forwarded to wallboard (display) server 120, then change the BOD alarm type to Low Voltage on the wallboard display 122 and Flash the Low-Voltage alarm text in red.
15. If the Low-Voltage alarm clears before the Battery On Discharge, then the wallboard (display) server 120 will change the Low Voltage back to a BOD alarm.

In one embodiment of the present invention, the network operator has the capability to manually "Delete" an alarm from the wallboard display 122, while in the Battery on Discharge method. The wallboard (display) server 120 may remove items from the wallboard display 122 even though the ticket may remain open. A refresh may be displayed based on a network operator's pre-defined work list query.

A high room temperature method is presented in the present invention. In one embodiment of the present invention, the high room temperature method includes the following steps:

1. The alert system 104 forwards alarm information to NIC 112.
2. The NIC 112 forwards alarm information (set_Clear_var=set, clear, alarm_inhibit_var=ALARM, inhibit, tech_no, alm_no) to the network portal 118, which determines whether the alarm information should be forwarded to wallboard (display) server 120 based on:

Technology number (i.e., tech_no) and alarm number (i.e., alm_no).
3. The wallboard (display) server 120 determines whether an inhibit method is operating on location_var location for particular technology number, alarm code, inhibit code (1-5):

If an inhibit method is operational, then terminate the alarm (do not display on wallboard display 122);

If an inhibit method is not operational, display the alarm information on the wallboard display 122.
4. If the High Room Temp method clears (set_clear_var=clear) before a ticket is created, then:

The NIC 112 sends clear signal to wallboard (display) server 120 via the network portal 118; and The wallboard (display) server 120 removes the alarm from wallboard display 122.
5. After a specified elapsed time, if the alarm still exists, the rule system 106 uses rules to create a ticket with Notify=SD and sends the alarm information (i.e., object, set_clear_var, tech_no, alm_no) to the ticket system 110.
6. The ticket system 110 automatically refreshes the work list based on the Notify=SD as well as once every five minutes.
7. The ticket system 110 notifies wallboard (display) server 120 that a ticket has been created/changed and forwards ticket information (ticket ID, Work location_var, Notify State) and alarm information generated by the rule system 106.
8. The wallboard (display) server 120 correlates existing pre-ticket alarm(s) to ticket alarm(s) and populates the ticket ID on the wallboard display 122.
9. If a network operator acknowledges the "SD" alarm, the ticket "Notify" field status changes from "SD" to "SA":

The ticket system 110 notifies the wallboard (display) server 120 of the change;

The wallboard (display) server 120 changes the "Notify" status of the associated alarm to "SA".
10. If any additional "SD" alarms are sent to ticket system 110 via the rule system 106 on the same ticket ID, then follow steps 6–9 and include alarm information generated by the alarm system 104.
11. If the alarm system 104/NIC 112 receives a "clear" (set_clear_var=clear) on any of the OPEN alarms, then:

NIC 112 sends "clear" to wallboard (display) server 120 via the network portal 118.
12. The wallboard (display) server 120 will use the alarm information to delete the alarm from the wallboard (display) server 120.

During the high room temperature method, the network operator has the capability to manually "Delete" an alarm from the wallboard display 122 at anytime; however, the alarm information will be automatically logged.

A stationary generator low fuel method is presented in the present invention. In one embodiment of the present invention, the stationary generator low fuel method includes the following steps:

1. The alarm system 104 forwards Standby Engine Run alarm information to the NIC 112 with alarm information.
2. The NIC 112 forwards alarm information (i.e., set_clear_var=set, clear, alarm_inhibit_var=ALARM, inhibit, tech_no, alm_no,—critical power alarms) to the network portal 118, which determines whether the alarm information should be forwarded to wallboard (display) server 120 based on:

The technology number (i.e., tech_no), and alarm number (i.e., alm_no).

3. The wallboard (display) server 120 determines whether an inhibit method is operating on location_var location for particular tech_no, alm_no, and inhibit code (1-5):

If an inhibit method is operating, then terminate the alarm (do not display to wallboard display 122);

If an inhibit method is not operating, display the alarm information on the wallboard display 122.

4. If Standby Engine Run method clears (set_clear_var=clear) before a ticket is created, then:

NIC 112 sends clear to wallboard (display) server 120 via network portal 118;

Wallboard (display) server 120 removes alarm from wallboard display 122.

5. After a specified elapsed time, if the alarm still exists, the rule system 106 uses rules to create a ticket with Notify=WS and sends alarm information to the ticket system 110, such as object, set_clear_var, tech_no, and alm_no.

6. The ticket system 110 should automatically refresh the work list based on the Notify=WS as well as once every five minutes.

7. The ticket system 110 notifies the wallboard (display) server 120 that a ticket has been created/changed and forwards the ticket information (ticket ID, Work location_var, Notify State) and alarm information provided by the ticket system 110.

8. The wallboard (display) server 120 correlates existing pre-ticket alarm(s) to ticket alarm(s) and populates the ticket ID on the wallboard display 122.

9. If the network operator acknowledges the "WS" alarm, the ticket "Notify" field status changes from "WS" to "WA":

The ticket system 110 notifies the wallboard (display) server 120 of the change;

The wallboard (display) server 120 changes the "Notify" status of the associated alarm to "WA":

10. If any additional "WS" alarms are sent to the ticket system 110 via the rule system 106 on the same ticket ID, then follow steps 6–9 and include new alarm information generated by the alarm system 104.

11. If alarm system 104/NIC 112 receives a "clear" (set_clear_var=clear) on any of the OPEN alarms, then:

NIC 112 sends "clear" to wallboard (display) server 120 via network portal 118.

12. The wallboard (display) server 120 will use the alarm information clear attributes to delete the alarm from the wallboard (display) server 120.

13. If a Low-Fuel alarm is received by the rule system 106, which sends a Notify=SD to the ticket system 110 and then forwards to wallboard (display) server 120, then:

Change the Standby Engine alarm type to Low Fuel on the wallboard display 122;

Change the Low-Fuel alarm text to red.

14. If the Low-Fuel alarm clears before the Standby Engine Run, then the wallboard (display) server 120 will change the Low Fuel back to a Standby Engine Run.

The network operator has the capability to manually "Delete" an alarm from the wallboard display 122 at anytime; however, this will be automatically logged.

A portable generator method is presented in the present invention. In one embodiment of the present invention, the portable generator method includes the following steps:

1. The alarm system 104 forwards alarm information (i.e., Commercial AC PWR Fail alarm information) to NIC 112.

2. NIC 112 forwards alarm information (set_clear_var=set, clear, alarm_inhibit_var=ALARM, inhibit, tech_no, alm_no) to network portal 118, which determines whether alarm data should be forwarded to wallboard (display) server 120 based on: tech_no and alm_no.

3. Wallboard (display) server 120 determines whether an inhibit method exists on location_var location for particular technology number (i.e., tech_no), alarm number (i.e., alm_no), and inhibit code (1-5):

If an inhibit method is operational, then terminate the alarm (do not display to wallboard);

If no inhibit method is operational, see next step.

4. Alarm system 104 forwards Battery On Discharge (BOD) alarm information to NIC 112 with additional alarm information (See Table 1):

Repeat step 2 (i.e., look for alarm system 104 Battery Related Events).

5. Alarm system 104 forwards clears on all BOD alarms to NIC 112, but Commercial AC PWR alarm still exists, then wallboard (display) server 120 displays Portable Generator On information on the wallboard display 122.

6. If Commercial AC PWR Fail clears (set_clear_var=clear) before a ticket is created, then NIC 112 sends clear to wallboard (display) server 120 via network portal 118;

Wallboard (display) server 120 removes alarm from wallboard display 122.

7. After a specified elapsed time, if Commercial AC PWR Fail, BOD alarm(s) still exists, rule system 106 uses rules to create a ticket with Notify=SD and sends alarm information to the ticket system 110, such as set_clear_var, tech_no, alm_no, etc.

8. If alarm system 104/NIC 112 receives "clears" (set_clear_var=clear) on all the BOD alarms, but the Commercial AC PWR Fail still exists, then the wallboard (display) server 120 displays Portable Generator On information on the wallboard with ticket ID, else:

9. NIC 112 receives the "clear" (set_clear_var=clear) for the Commercial AC PWR Fail from alarm system 104 and forwards alarm information to the wallboard (display) server 120.

10. Wallboard (display) server 120 removes Portable Generator On information from the wallboard display 122. The network operator has the capability to manually "Delete" an alarm from the Wallboard display 122 at anytime; however, this is automatically logged.

A network events method is presented in the present invention. In one embodiment of the present invention, the network events method includes the following steps:

1. A network operator receives a call from internal/external user/vendor stating a power network event will be performed at specific work location_var and provides network ticket number, or ticket number.

2. The network operator queries the ticket system 110 using the network ticket number to determine the ticket ID and then performs the following:

Retrieves ticket information from ticket system 110;

Reviews the ticket information and changes ECD (Estimated Completion Date), if necessary;

Reviews network ticket information, if necessary;
Saves ticket information to a work list.

3. The ticket system 110 will forward ticket information (ticket ID, Date/Time, Work location_var, ECD, Assign ID) to wallboard (display) server 120 (if save is done).
4. The wallboard (display) server 120 will generate display information to display the network event on the wallboard display 122.
5. If an internal/external user/vendor informs the network operator that work has been completed early, then the following occurs:
   Network event operator reviews the network ticket information (from Network Event work list) for details and associated alarms at the location_var location that may or may not be related;
   Network events operator deletes the ticket from the work list. The ticket system 110 will notify wallboard (display) server 120 to delete the ticket from the wallboard display 122, else:
6. XX minutes (ex: 30 minutes) after ECD date/time, the wallboard (display) server 120 displays the Network Event in red.
7. Once the network operator sees the network event in red, they may do the following:
   Call the internal/external user/vendor to determine status;
   If status is ok, then delete ticket from work list. The ticket system 110 will notify wallboard (display) server 120 to delete the ticket from the wallboard display 122;
   If status is not ok, then take predefined steps.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

It is, therefore, intended by the appended claims to cover any and all such applications, modifications, and embodiments within the scope of the present invention.

What is claimed is:

1. A method of processing power alarms comprising the steps of:
receiving first power alarm information representing an alarm;
determining if an inhibit method is operating in response to the first power alarm information;
displaying second power alarm information in response to determining if the inhibit method is operating;
determining if a ticket has been generated;
receiving ticket information in response to determining if the ticket has been generated;
correlating the first power alarm information and the ticket information in response to receiving the ticket information; and
generating third power alarm information by updating the second power alarm information in response to correlating the first power alarm information and the ticket information.

2. A method of processing power alarms as set forth in claim 1, wherein the first power alarm information represents a battery on discharge alarm.

3. A method of processing power alarms as set forth in claim 1, wherein the first power alarm information represents a stationary generator alarm.

4. A method of processing power alarms as set forth in claim 1, wherein the first power alarm information represents a portable generator alarm.

5. A method of processing power alarms as set forth in claim 1, wherein the first power alarm information represents a high room temperature alarm.

* * * * *